US008458815B1

(12) United States Patent
Green

(10) Patent No.: US 8,458,815 B1
(45) Date of Patent: Jun. 11, 2013

(54) ATHLETIC GLOVE WITH INNER GRIP

(76) Inventor: Donald Green, Owings Mills, MD (US)

( * ) Notice: Subject to any disclaimer, the term of this patent is extended or adjusted under 35 U.S.C. 154(b) by 0 days.

(21) Appl. No.: 13/299,451

(22) Filed: Nov. 18, 2011

(51) Int. Cl.
*A41D 19/00* (2006.01)

(52) U.S. Cl.
USPC ..... 2/161.1

(58) Field of Classification Search
USPC ..... 2/16, 20, 21, 159, 161.1, 161.6, 161.3, 2/163, 168, 169
See application file for complete search history.

(56) References Cited

U.S. PATENT DOCUMENTS

| | | | | | |
|---|---|---|---|---|---|
| 723,348 | A * | 3/1903 | Wilkens | 2/164 |
| 2,907,046 | A | 10/1959 | Scherr | |
| 3,096,523 | A | 7/1963 | Bruchas | |
| 3,649,967 | A * | 3/1972 | Millman | 2/161.3 |
| 4,689,832 | A | 9/1987 | Mulvaney | |
| 5,317,759 | A * | 6/1994 | Pierce | 2/161.7 |
| 5,500,956 | A * | 3/1996 | Schulkin et al. | 2/161.1 |
| 5,692,242 | A | 12/1997 | Tekerman et al. | |
| 5,794,266 | A * | 8/1998 | Han | 2/159 |
| 5,983,395 | A * | 11/1999 | Lei | 2/159 |
| 7,234,170 | B2 * | 6/2007 | Simic | 2/16 |
| 7,293,296 | B1 * | 11/2007 | Beraznik et al. | 2/161.1 |
| 7,802,314 | B2 * | 9/2010 | Cohen | 2/161.1 |
| 2007/0209097 | A1 | 9/2007 | Iacullo | |

* cited by examiner

*Primary Examiner* — Tejash Patel
(74) *Attorney, Agent, or Firm* — Larry J. Goffey

(57) ABSTRACT

An improved sports glove, of the type that includes a membrane that is generally configured to be worn on a wearer's hand so that the interior surface of the membrane comes in contact with the glove wearer's hand, has the improvements of a plurality of sensitizing elements that are attached to the membrane's interior surface for sensitizing the portion of the glove wearer's hand that adjoins these elements so as to enhance the wearer's ability to handle a piece of sports equipment.

13 Claims, 1 Drawing Sheet

ATHLETIC GLOVE WITH INNER GRIP

BACKGROUND OF THE INVENTION

1. Field of the Invention

The present invention relates generally to athletic equipment, more particularly to an athletic glove for improving a person's ability to grip or otherwise handle a piece of sports equipment.

2. Description of the Related Art

Many sports and occupations require gloves for hand protection. Not only is hand protection important, but dexterity and comfort are needed as well. In addition, certain uses of gloves subject them to extensive wear and movement, which, in turn, create a need for durability, stretchability, and flexibility. Certain applications also require excellent gripping characteristics, such as sports that require skillful and adept handling of sports equipment (e.g., balls, bats, sticks and clubs).

Many prior art, athletic or sports gloves have attempted to introduce various innovations so as to enhance the ability of one who wears such gloves to grip and control a piece of sports equipment. These innovations include the incorporation into sports gloves of various types of strategically-located materials, such as neoprene—U.S. Pat. No. (USPN) 3,096,523, knitted stretch yarn gloves with thin, pliable leather portions—USPN 2,907,046, a sewn leather glove with a tackified outer surface—U.S. Pat. No. 4,689,832, vinyl rubber pads having finlike grippers—U.S. Patent Publication No. (USPPN) 2007/0209097, desensitizing elements which attempt to train the hand to develop a heightened sense of touch—U.S. Pat. No. 5,692,242, and an assortment of gloves that have spandex-like back of the hand portions and polyester palms.

None of these prior art gloves utilize materials on the inside of the gloves that seek to heightened a user's sense of touch as a means of enhancing a user's ability to grip and control a piece of sports equipment.

Thus, despite an abundance of sports gloves in the marketplace, there is still a need for an improved sports glove that will further enhance a user's ability to grip and control a piece of sports equipment.

SUMMARY OF THE INVENTION

Recognizing the need for the development of an improved athletic or sports glove, the present invention is generally directed to satisfying the needs set forth above and overcoming the problems and disadvantages exhibited by prior sports gloves.

In accordance with a preferred embodiment of the present invention, an improved athletic or sports glove, of the type that includes a membrane with digit portions intended to cover one's fingers and thumb and that is generally configured to be worn on a wearer's hand so that the interior surface of the membrane comes in contact with the wearer's hand, has the improvements of a plurality of sensitizing elements that are attached to the membrane's interior surface and which are capable of sensitizing the portion of a wearer's hand that adjoins these elements so as to thereby enhance the wearer's ability to handle a piece of sports equipment.

Many materials have been found to be suitable for use as such sensitizing elements. These include those having outer surfaces having sufficient surface roughness. For example, sufficient surface roughness is achieved by having a base material with protuberances extending from it at heights in the range of 0.015-0.050 inches and packing densities in the range of 150-500 protuberances per square inch of base material. Such roughness can be achieved by using the rough or "hook" side of assorted types of hook and loop fasteners (i.e., a hook and loop fastener is said to have two sides or faces that come together to provide a fastening action, where the soft fuzzy side is the "loop" or "pile" side and rough side is the "hook" side).

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1:
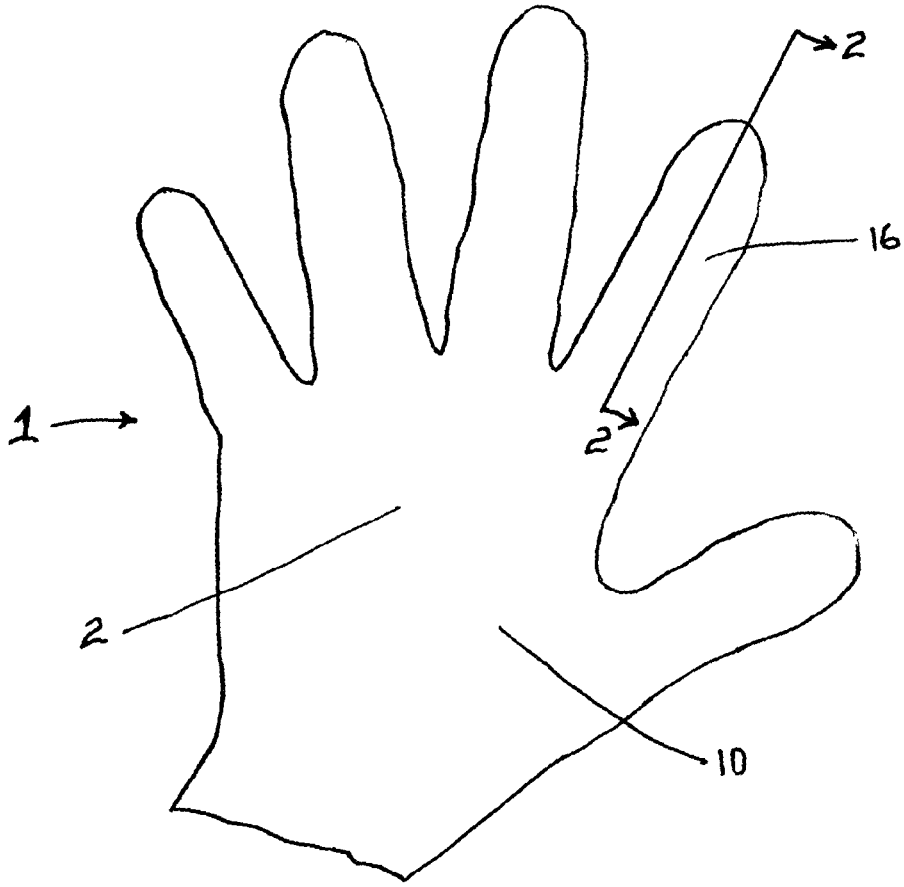
FIG. 1 is a plan view of the back-side of a glove according to a preferred embodiment of the present invention.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Referring to FIG. 1, there is illustrated a preferred embodiment of the present invention 1 which is illustrated in the plan view of the back-side 2 of an athletic or sports glove. This glove 1 is seen to be of the typical construction that includes a membrane 10 which has an interior side or surface 12 and an exterior side or surface 14. This membrane is generally configured so as to allow it to enclose and be worn as a glove on a wearer's hand, or at least a portion of the hand. The membrane has a number of digit portions 16, each of which is further configured to cover a finger or thumb (i.e., digits of the hand) on the hand of the one wearing the glove.

Figure 2:
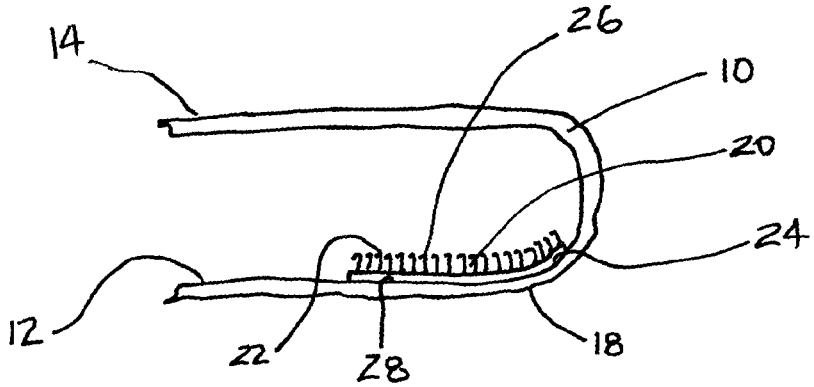
FIG. 2 is a cross-sectional view taken along line 2-2 of the end portion of a representative digit of the glove shown in FIG. 1 and which shows the interior surface of the glove.

FIG. 2 shows a cross-sectional view taken along line 2-2 of the end portion of the index finger of the glove shown in FIG. 1. This view is useful because it shows the interior surface 12 of this digit portion of the glove and therefore that portion 18 of the exterior surface of the glove's membrane (or, if the glove were not being worn, that portion of one's hand—the palm and the adjoining front surface of a wearer's fingers and thumb) that would eventually come into contact with any piece of sports equipment which the glove's wearer might be trying to grip and control.

This view also shows a novel component of this sports glove—a sensitizing element 20 or means that is especially configured to further sensitize or provide enhanced or greater sensitivity for that portion of a person's hand which comes into contact with the outer surface 22 of this element. This element's inner surface 24 is affixed to the interior surface of the membrane. This element 20 is novel in that it differs greatly from the padding-types of materials that can sometimes be attached to sports gloves in these high-contact-with-sports-equipment portions 18 of such a glove and which can often have the unintended consequence of desensitizing a wearer's hand in those areas or portions that are most essential for a wearer to have good, sensitive contact with a piece of sports equipment which the glove wearer wishes to grip, handle, manipulate and control.

After a significant amount of investigating the performance of various candidate materials to serve as such sensitizing elements 20, it was found that two characteristics of these materials were key factors in predicting how they would perform their desired sensitizing tasks. One of these factors is the relative roughness of the outer surface 22 (i.e., that surface which comes into direct contact with a glove wearer's hand) of the element 20 or material. For the purposes of describing such a roughened surface herein, we idealize them by referring to them as having protuberances 26 whose tips stand at an average height above a base material 28 having a uniform base thickness and with these protuberances having a certain packing density which we express as the number of protuberances that extend upward per unit area from the base material. Thinner base thickness materials have generally been found to perform better, but with this thickness sometimes also being a function of where on the interior surface 12 of the membrane 10 the material or element 20 was to be attached.

A number of materials were found to adequately perform this element's sensitizing task. These include the rough or "hook" side of assorted types of hook and loop fasteners (i.e., a hook and loop fastener is said to have two sides or faces that come together to provide a fastening action, where the soft fuzzy side is the "loop" or "pile" side and rough side is the "hook" side). For example, within the hook and loop fastener industry, a standard heavy duty hook material is made from a 0.008 inch diameter, nylon monofilament that is woven so as to have over 300 hooks per square inch and such that the loose ends of its hooks stand to an average height of approximately 0.030 inches above the base of this woven material.

A wide range of raw materials (e.g., thermoplastic monofilaments of polyethylene, polypropylene, polyester and vinyl in diameters of 0.005-0.020 all appear to have sufficient stiffness to make good hooks) and weaving patterns (e.g., hooks per square inch of 150-500, and average heights of 0.015-0.050 inches) seem to, in certain situations, to yield woven materials with sufficient surface roughness for the sensitizing task of the present invention. The manufacturing technology for such "hook" materials has progressed to the point that they are also made today by plastic molding operations. Similarly, other materials (rubber, leather, metal, wood pulp, molten minerals) and manufacturing technologies (non-wovens, paper making processes) can be used to fabricate sheet-like materials having sufficient surface roughness to enable them to be used for the sensitizing elements of the present invention. All of these materials are considered to come with the scope of the present invention.

Depending upon the type of sport being played with the glove/s of the present invention, the number and individual surface areas of the sensitizing means or elements 20 to be attached on a glove's interior surfaces 12 can vary widely. The optimum locations of these sensitizing elements 20 will also be a function of the type of sport for which the present invention's glove/s are being worn. A glove wearer's personal preferences can also enter into the decision as to the ideal number, size and location of these sensitizing elements 20. However, with a relatively few number of trials or experiments these decision can be made for even the most hard to satisfy glove wearer. Thus, all such combinations of the optimum number, size and location of sensitizing elements 20 within a sports glove are considered to come within the scope of the present invention.

However, to give a representative example—it was found that five sensitizing elements, each of which is located in one of the end portions of a glove's digits and sized so that they cover and adjoin a wearer's finger or thumb tip, were very effective in sensitizing these portions of a wearer's hand. Wearers of such glove on both hands frequently reported that they were better able to grip, handle and catch a football.

Specialized sports gloves with such sensitizing elements can also be used as teaching aids to sensitize selected portions of a player's digits so as to teach the player to more fully use these portions of the player's hand when trying to manipulate and control and a piece of sports equipment in a certain manner (e.g., more effectively utilize the index and middle finger tips on one's hand to throw and control the rotation on a baseball; more effectively utilize the little, ring and middle fingers on one's hand to control a golf club).

The foregoing is considered as illustrative only of the principles of the invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is hereinafter set forth in the claims to the invention.

I claim:

1. A sports glove of the type that is worn on the hand of a person for improving the ability of said glove wearer to handle a piece of sports equipment, said glove comprising:

a membrane having an interior side and an exterior side and a configuration that allows said membrane to enclose and be worn as a glove on at least a portion of the hand of said glove wearer, a plurality of means for enhancing the sensitivity of that portion of a person's hand that adjoins each of said means for enhancing sensitivity, and wherein each of said means for enhancing sensitivity being attached to the interior side of said membrane and positioned so as to adjoin an area on the hand of said glove wearer where said glove wearer is seeking enhanced sensitivity for improving the ability of said glove wearer to handle a piece of sports equipment.

2. The sports glove as recited in claim 1, wherein:

each of said means for enhancing sensitivity configured to have an outer surfaces having a specified surface roughness that is selected so as to provide said glove wearer with said desired enhanced sensitivity for greater ability to handle a piece of sports equipment.

3. The sports glove as recited in claim 2, wherein:

said means for enhancing sensitivity of outer surfaces having a base material from which extend protuberances, and said protuberances are configured so as to have average heights selected from the ranges of 0.015-0.050 inches.

4. The sports glove as recited in claim 3, wherein:

said protuberances are arranged so as to have average packing densities selected from the ranges of 150-500 protuberances per square inch of said base material.

5. The sports glove as recited in claim 2, wherein:

each of said means for enhancing sensitivity fabricated from the hook portion of a suitably configured hook and loop fastener.

6. The sports glove as recited in claim 3, where each of said means for enhancing sensitivity fabricated from the hook portion of a suitably configured hook and loop fastener.

7. The sports glove as recited in claim 4, wherein:

each of said means for enhancing sensitivity fabricated from the hook portion of a suitably configured hook and loop fastener.

8. The sports glove as recited in claim 1, wherein:

said membrane having a plurality of digit portions, each of which is configured to cover a digit on the hand of said glove wearer, and at least one of said means for enhancing sensitivity being attached to the interior side of one of said plurality of digit portions of said membrane.

9. The sports glove as recited in claim 2, wherein:

said membrane having a plurality of digit portions, each of which is configured to cover a digit on the hand of said glove wearer, and at least one of said means for enhancing sensitivity being attached to the interior side of one of said plurality of digit portions of said membrane.

10. The sports glove as recited in claim 4, wherein:

said membrane having a plurality of digit portions, each of which is configured to cover a digit on the hand of said glove wearer, and at least one of said means for enhancing sensitivity being attached to the interior side of one of said plurality of digit portions of said membrane.

11. The sports glove as recited in claim 7, wherein:

said membrane having a plurality of digit portions, each of which is configured to cover a digit on the hand of said glove wearer, and at least one of said means for enhancing sensitivity being attached to the interior side of one of said plurality of digit portions of said membrane.

12. The sports glove as recited in claim 8, wherein:

said means for enhancing sensitivity being attached to the interior side of one of said plurality of digit portions of said membrane so as to allow said glove to be used as a teaching aid in instructing said glove wearer to better handle and control a piece of sports equipment.

13. The sports glove as recited in claim 11, wherein:

said means for enhancing sensitivity being attached to the interior side of one of said plurality of digit portions of said membrane so as to allow said glove to be used as a teaching aid in instructing said glove wearer to better handle and control a piece of sports equipment.

* * * * *